United States Patent [19]

Danforth et al.

[11] Patent Number: 4,947,622

[45] Date of Patent: Aug. 14, 1990

[54] APPARATUS AND METHOD FOR PLACING EXPANSIBLE LIDS ON CONTAINERS

[75] Inventors: Ronald V. Danforth, West Springfield, Mass.; Medric H. Pleau, Vernon, Conn.

[73] Assignee: Packaging Systems International, Inc., Ellington, Conn.

[21] Appl. No.: 354,471

[22] Filed: May 19, 1989

[51] Int. Cl.[5] ..... B65B 7/28

[52] U.S. Cl. ..... 53/487; 53/291

[58] Field of Search ..... 53/291, 295, 399, 441, 53/556, 585, 485, 487

[56] References Cited

U.S. PATENT DOCUMENTS

| | | | |
|---|---|---|---|
| 1,831,883 | 11/1931 | Risser . | |
| 1,835,336 | 12/1931 | Risser . | |
| 2,149,377 | 3/1939 | Winslow . | |
| 2,164,026 | 6/1939 | Seymour . | |
| 2,173,803 | 9/1939 | Gammeter . | |
| 2,178,429 | 10/1939 | Lowry . | |
| 2,193,128 | 3/1940 | Gammeter | 53/293 |
| 2,834,170 | 5/1958 | Robinson . | |
| 2,924,926 | 2/1960 | Paine | 53/585 X |
| 4,144,631 | 3/1979 | Fujio | 53/585 X |
| 4,188,249 | 2/1980 | Fujio | 53/585 X |
| 4,312,173 | 1/1982 | Killermann . | |
| 4,401,020 | 8/1983 | Brux . | |
| 4,442,765 | 4/1984 | Limehouse et al. | 53/556 X |
| 4,470,241 | 9/1984 | Parry et al. . | |
| 4,519,178 | 5/1985 | Crabb, Jr. . | |
| 4,601,155 | 7/1986 | Lewis . | |
| 4,885,898 | 12/1989 | Khurgin | 53/556 X |

*Primary Examiner*—Robert L. Spruill
*Assistant Examiner*—Linda B. Johnson

[57] ABSTRACT

A container sealing machine for placing an elastomeric lid with a transverse wall and a depending sidewall upon the open upper end of the container has a frame providing a cavity adapted to receive therein the upper portion of the container. A multiplicity of stretching fingers are movably mounted on the frame and extend inwardly of the cavity. The fingers have upstanding lips at their inner ends adapted to engage the inside surface of the sidewall of the lid and are movable relative to the cavity. Initially, this movement stretches the lid and thereafter it causes the sidewall of the lid to be moved off the lips, and the sidewall of the lid then contracts against the sidewall of the container to effect its sealing. Generally, the finger moving means includes a base plate on which the fingers are slidably seated, a base plate on which the fingers are slidably seated, and a rotatable cam ring above the fingers which cooperate to produce the movement of the fingers.

17 Claims, 5 Drawing Sheets

APPARATUS AND METHOD FOR PLACING EXPANSIBLE LIDS ON CONTAINERS

BACKGROUND OF THE INVENTION

The present invention relates to lid applying devices for containers and, more particularly, to devices for applying an stretchable lid to the upper end of a container.

Presently various types of lids or caps are employed on containers for liquids and the like, and it is a requirement that such lids be able to be placed upon the container rapidly and effect a reasonably good seal about the upper end of the container. To provide such lids at relatively low cost, synthetic resins are widely employed to provide preformed lids with transverse walls and depending sidewalls which will deform about a lip at the upper end of the container as they are pressed downwardly. Generally, the synthetic resins employed for such lids comprise polystyrene, polyethylene and polyprpylene, and they are responsible for a great deal of the contamination of our seashore and parks since they do not readily degrade. Moreover, the relatively rigid nature of the synthetic resin lids limits the amount of deformation which can be effected so that the seal is not always so effective as would be desired. As a result, impacts upon the container frequently will cause the lids to jump off the tops of the containers and cause spillage.

It is an object of the present invention to provide a novel machine for applying elastomeric lids to the open tops of containers.

It is also an object to provide such a machine which may be operated automatically or semi-automatically to rapidly place such lids on the tops of the containers.

Another object is to provide such a machine which may be fabricated readily and economically from durable parts so that it may be utilized even in relatively small food dispensing establishments.

Yet another object is to provide a novel method for effecting the placement of such elastomeric lids upon the open ends of containers.

SUMMARY OF THE INVENTION

It has now been found that the foregoing and related objects may be readily attained in a container sealing machine for placing upon the open upper end of a container an elastomeric lid having a transverse wall and a depending sidewall extending thereabout. The machine includes a frame providing a cavity adapted to receive the upper portion of a container to be capped and a multiplicity of stretching fingers movably mounted on the frame and extending inwardly of the cavity. The fingers have upstanding lips at their inner ends adapted to engage the inside surface of the sidewall of an associated lid. Also included is means for moving the fingers outwardly relative to the cavity, thereby initially to stretch the associated lid and thereafter effecting further movement of said fingers to cause the sidewall of the associated lid to be moved off the lips on the fingers. As a result, the sidewall of the lid will contract against the sidewall of the associated container and effect sealing of the upper end thereof.

Preferably, the frame includes a base plate with an aperture therein to partially define the cavity, and the fingers being slidably mounted on the upper surface of the base plate. Each of the fingers has a stripper blade thereon, and its inner end is movable upwardly during the outward movement of the fingers to push the associated lid upwardly and thereby off the lip of the fingers. Mounted on the upper surface of the base plate is a cam ring rotatable about a vertical axis, and the cam ring and fingers having coacting means thereon to produce the outward movement of the fingers upon the rotation of the came ring.

Desirably, the coacting means comprises an angularly oriented cam track on one of the cam ring and fingers and a cam follower on the other which is seated in the cam track. Most usually, the cam track is a channel formed in the cam ring.

The base plate has an upwardly sloping cam surface coacting with a second cam follower seated therein and acting on the inner end portion of the stripper blade to cam it upwardly. Preferably, a housing is disposed about the frame and it provides a cavity into which an associated container may be placed through an aperture in the housing.

Lifting means is provided for moving the associated container upwardly in the cavity into the aperture in the base plate.

DETAILED DESCRIPTION OF THE ILLUSTRATED EMBODIMENTS

Figure 1:
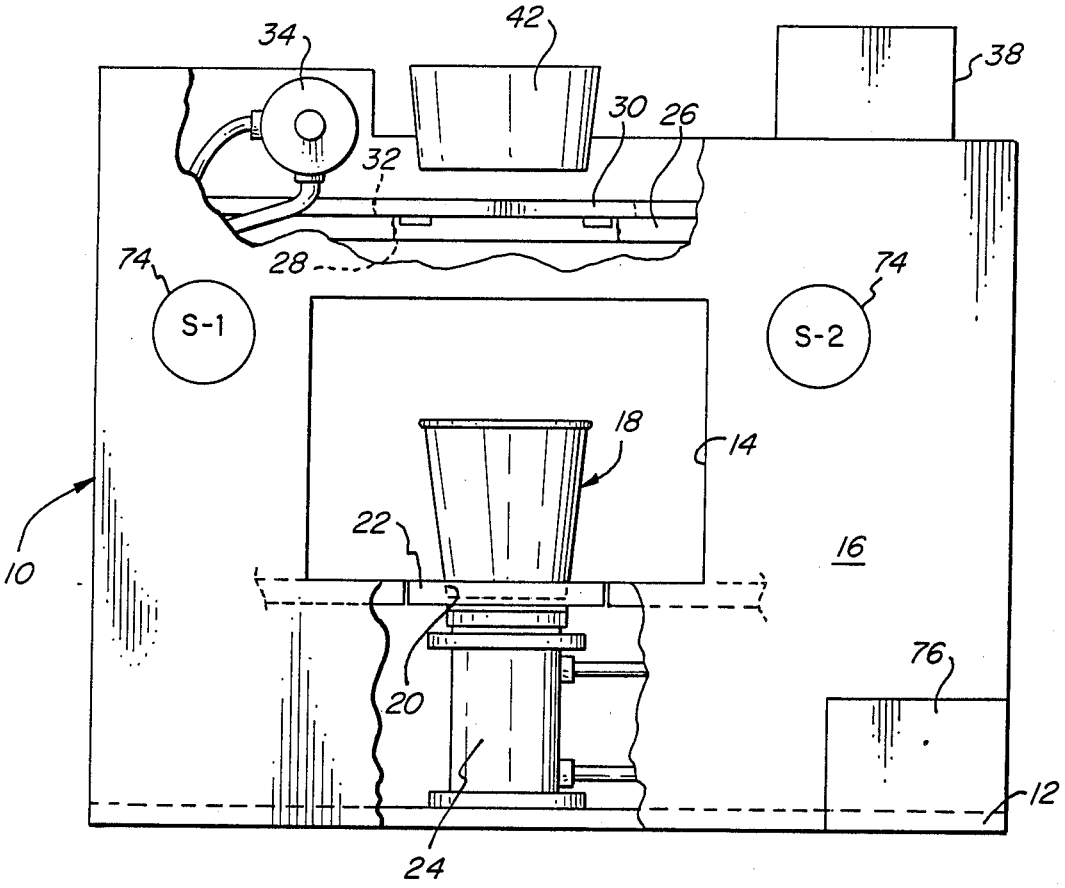
FIG. 1 is a partially diagrammatic front view of a lid applying machine embodying the present invention with portions of the housing broken away to illustrate internal construction.

Turning first to FIG. 1, therein illustrated is a semi-automatic lid applying machine embodying the present invention which has a housing generally designated by the numeral 10 about a frame generally designated by the numeral 12. The housing 10 has an access aperture 14 in the front wall 16 thereof through which a container 18 to be sealed may be introduced and seated in the recess 20 of the cup holder 22. A pneumatic lift cylinder 24 in the base of the housing 10 will move the cup holder upwardly as will be described more fully hereinafter.

The frame 12 includes a transversely extending base plate generally designated by the numeral 26, and it has a circular aperture 28 therein through which the container 18 may pass upon elevation by the lift cylinder 24. Supported for rotation on the base plate 26 is a cam ring 30 which has a circular aperture 32 therein aligned with that of the base plate 26, and also supported thereon is a pair of pneumatic actuating cylinders 34, 36 to effect limited (only 34 is shown in FIG. 1) rotation of the ring 30 on the base plate 26.

A lid delivery assembly generally designated by the numeral 38 is disposed in the top of the housing 10 to drop individual lids 40 into a chute 42 which drops them into the aperture 32 of the cam ring 30.

Figure 2:
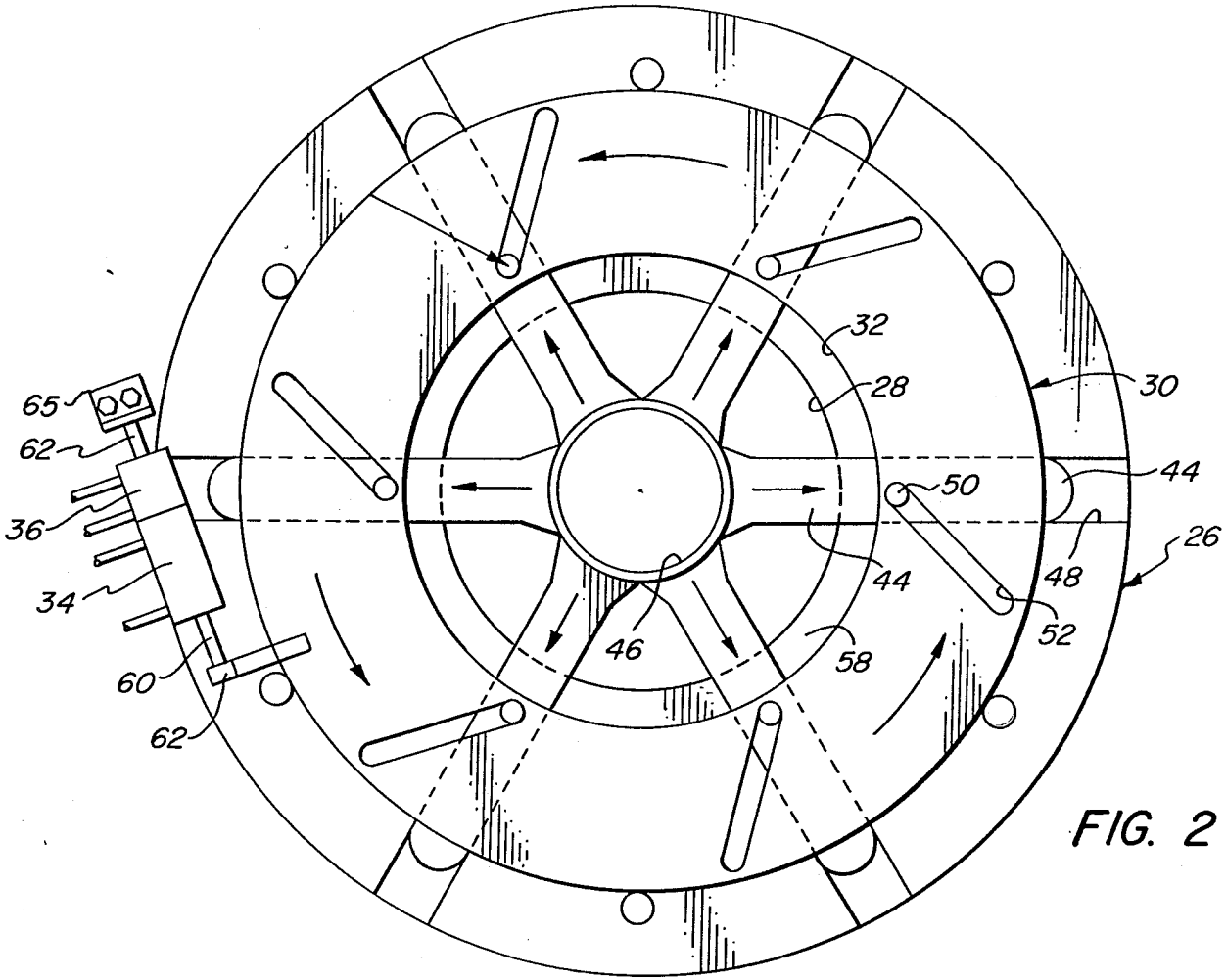
FIG. 2 is a plan view of the operative lid stretching assembly in the upper portion thereof drawn to an enlarged scale.
Figure 3:
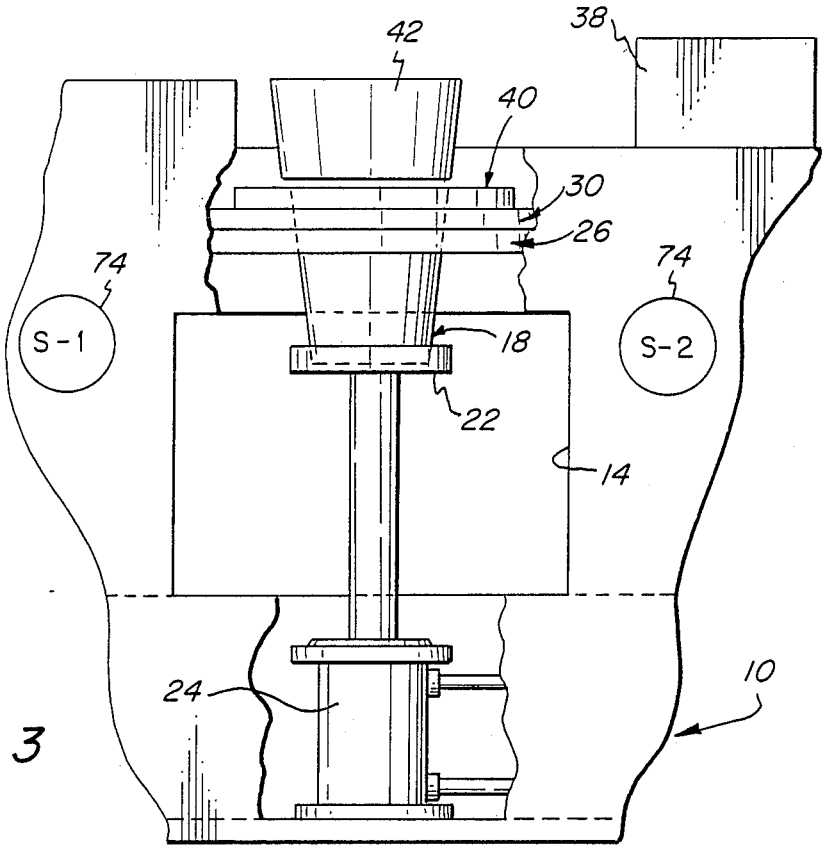
FIG. 3 is a front elevational view of the operational components showing the container elevated to receive the lid and with parts in section for clarity of illustration.
Figure 4:
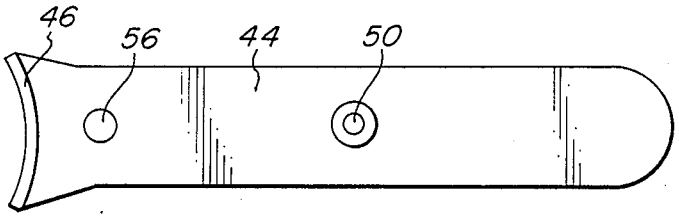
FIG. 4 is a plan view of one of the stretching fingers.
Figure 5:
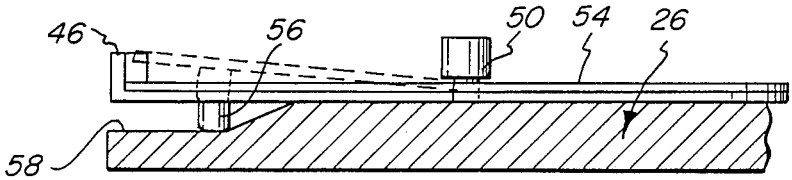
FIG. 5 is a side elevational view of the subassembly of the subassembly of a stretching finger and stripper blade seated in the channel of a base plate fragmentarily shown in section.

Turning now to FIGS. 2, 4 and 5, the lid stretching assembly includes elongated stretching fingers 44 having an upstanding arcuate lip 46 at their inner ends and seated in radially extending channels 48 in the base plate 26. Projecting upwardly from the fingers 44 are cam follower pins 50 which slidably seat in the secantally oriented cam slots 52 in the cam ring 30.

Supported on each of the stretching fingers 44 is a resiliently deflectable stripper blade 54. A lifting pin 56 extends downwardly through an aperture in the stretching finger 44 and slides along a cam surface portion 58 at the outer end of the channel 48 to flex the blade 54 upwardly as the stretching finger 44 is moved outwardly.

As best seen in FIG. 2, the cylinders 34, 36 are mounted back to back. The piston 60 of the cylinder 35 is secured to the plate 62 projecting from the cam ring 30 and the piston 64 of the cylinder 36 is secured to the mounting bracket 64 on the base plate 26. Upon activation of the cylinder 34, the cam ring 30 will be rotated an initial distance, and, upon activation of the cylinder 36, the cam ring 30 will be rotated an additional distance. Spaced about the base plate 26 are guide rollers 63 which provide bearing surfaces for the periphery of the cam ring during its rotation.

As the cam ring 30 rotates, the stretching fingers 44 are moved outwardly in the channels 48 by the coaction of the cam follower pins 50 in the cam slots 52. As the fingers 44 near the outer range of their movement, the lifting pins 56 are cammed upwardly by the cam surface portion 58. When the action of the cylinders 34, 36 is reversed, the fingers 44 are moved back to their initial position.

The supply of air to the several cylinders 24, 34, 36 is initiated by the switches 74 on the exterior of the housing 10 and the controller 76. The machine is connected to a suitable source of air under pressure (not shown).

Figure 11:
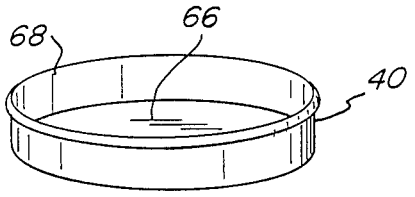
FIG. 11 is a perspective view of a stretchable lid used in the present invention.
Figure 12:
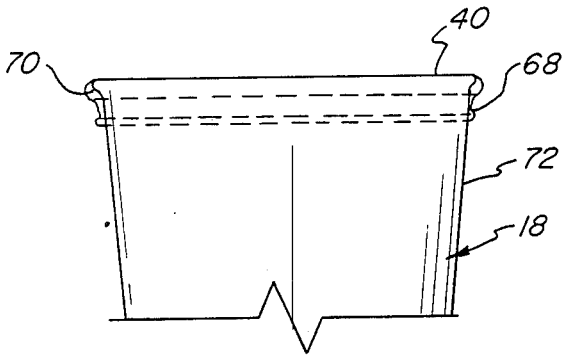
FIG. 12 is a fragmentary sectional view of the container with the lid applied thereto.

In FIG. 11, there is illustrated an elastomeric lid used in the present invention generally designated by the numeral 40 having a transverse wall 66 and a peripheral wall 68. In FIG. 12, the lid 40 is shown as sealing a conventional container cup 18 with a lip 70 about its upper end. As can be seen, the peripheral wall 68 of the lid 40 tightly seats upon the lip 70 and a portion of the peripheral wall 72 therebelow.

Turning now to FIGS. 6–10, therein diagrammatically illustrated are the several steps in the operation of the machine to effect the stretching of the lid and placement thereof upon the top end of the container.

Figure 6:
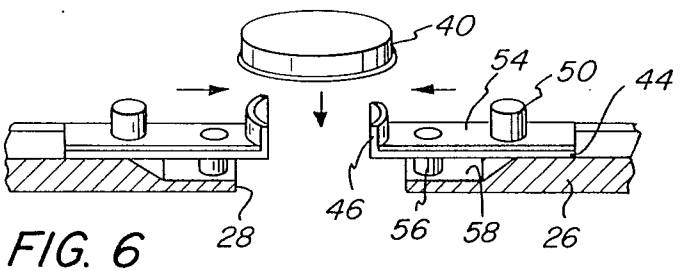

In FIG. 6, the stretching fingers 44 have been moved fully inwardly as indicated by the arrows 78 and the container 18 is disposed below the base plate 26. The lid 40 is shown as being dropped downwardly towards the lips 46 on the stretching fingers 44 (only two of which are shown).

Figure 7:
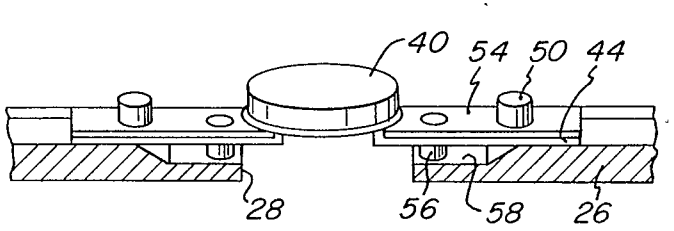

In FIG. 7, the lid 40 is shown seated over the stretching fingers 44.

Figure 8:
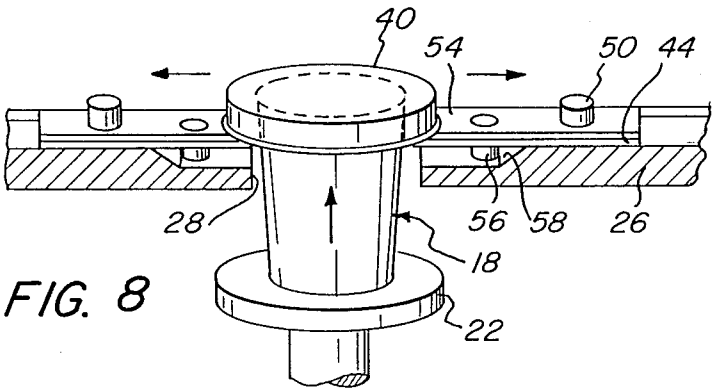

In FIG. 8, the stretching fingers 44 are being moved outwardly as shown by the arrows 80 and this has effected stretching of the lid 64. Concurrently, the lift cylinder 24 is moving the cup holder 22 upwardly to move the container 18 upwardly against the transverse wall 66 of the lid 40.

Figure 9:
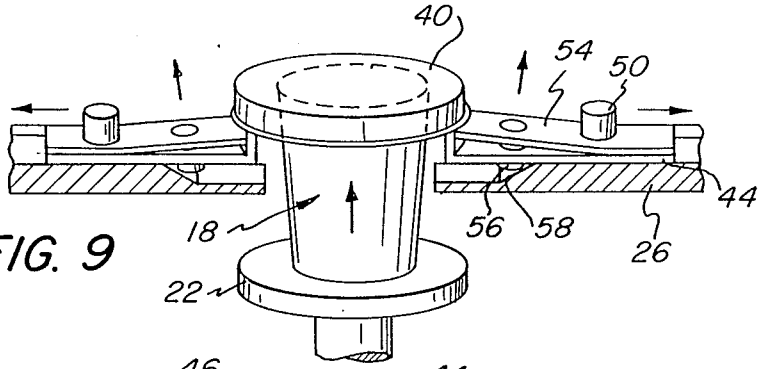
FIGS. 6–10 are diagrammatic views showing the components at several points in the lid stretching and application process.
Figure 10:
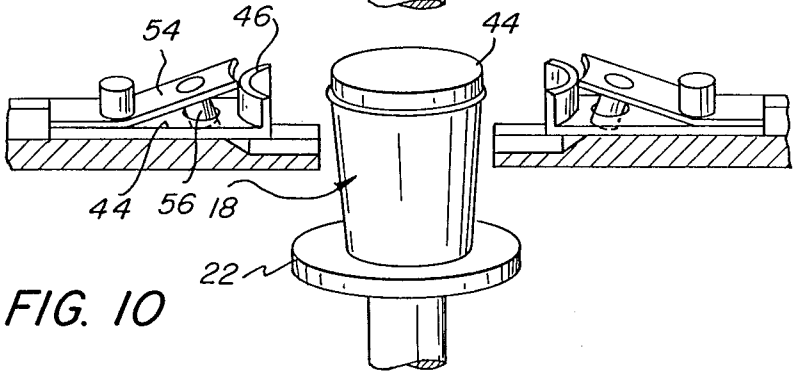

As seen in FIG. 9, the continued upward motion of the lift cylinder 24 and the upwardly camming motion of the inner ends of the stripper blades 54 are moving the lid 64 off the upper ends of the stretching fingers 44. As shown in FIG. 10, the lid has been fully released from the stretching fingers 44 and has contracted so as to clamp tightly about the upper end of the container 18.

Although the configuration and dimensioning of the stretching fingers may vary considerably, generally it is desirable that they be elongated to ensure stable tracking in the channels in the base plate and that they have an arcuate upstanding lip so as to conform closely to the circular peripheral wall of the lid. Similarly, the stripper blades should have an inner arcuate edge surface so that they will wipe closely against the inner surface of the lips of the stretching fingers.

Although as few as three stretching fingers could be employed to effect the stretching of the lid, it is preferable to employ at least four, and desirably at least six, to ensure fast, uniform and reliable stretching of the lid and disposition over the container. As can be seen in FIG. 2, the side edges of the lip portions of the stretching fingers abut in the inward position thereof, and they will separate as they move outwardly in the channels.

The cylinders 34, 36 are actuated in sequence. Generally, a one-inch stroke on the cylinder 34 will produce the desired stretching action illustrated in FIGS. 6–8, and a one-half inch stroke for the cylinder 36 initiated after the container 18 has been moved upwardly to abut the lid 40 will produce the camming action of the stripper blades 54 to effect the release of the lid 64 therefrom and its prompt retraction about the upper end of the container 18. Although pneumatic cylinders have been described to effect the rotation of the cam plate relative to the base plate and to effect the operation of the lift cylinder 24, hydraulics, and mechanical or electrical drive systems using gears arrangements may be utilized if so desired.

The means for delivery of the lids individually to the feed chute for disposition on top of the containers may vary substantially. Generally, a vacuum pick off for removing a single lid from a stack of the nested lids will be satisfactory. However, mechanical separators and other types of delivery devices may also be utilized.

As illustrated in the drawings, a pair of switches external to the device is provided for the operator to initiate the motion of the cylinder. This is a safety device to require placement of both hands on switches on opposite sides of the unit to ensure that both of the operator's hands are external to the housing at the time that operation has commenced.

The machine is preferably semi-automatic in operation so that actuation of the switch will cause delivery of the lid, stretching of the lid, movement of the container upwardly, and movement of the container downwardly to a position where it can be removed by the operator.

The elastomeric lids used in the machines of the present invention are desirably biodegradable, and natural rubber latex is preferred.

Although the stripper blades facilitate the removal of the lid from the lips of the fingers, they may be illuminated if the container is moved upwardly to distend the transverse wall upwardly after which the stretching fingers are closed partially. This change in angle of distention of the peripheral wall causes the lid to lift off the lips of the fingers.

Thus, it can be seen that the sealing machine of the present invention is one which simply and effectively stretches elastomeric lids for placement over the upper end of containers. It is readily adapted to automatic and semi-automatic operation, and it may be fabricated from components which are rugged and reliable in operation. Moveover, the machine may be fabricated relatively economically so that such sealing devices may be available to small food dispensing institutions to eliminate the presently widely employed plastic covers which present environmental problems.

Having thus described the invention, what is claimed is:

1. In a container sealing machine for placing an elastomeric lid having a transverse wall and a depending sidewall extending thereabout upon the open upper end of a container, the combination comprising:

(a) a frame providing a cavity adapted to receive therein the upper portion of a container to be capped;

(b) a multiplicity of stretching fingers movably mounted on said frame and extending inwardly of said cavity, said stretching fingers having upstanding lips at their inner ends adapted to engage the inside surface of the sidewall of an associated lid;

(c) a stripper blade on each of said stretching fingers, said stripper blades having their inner ends movably supported thereon for vertical movement relative to its associated stretching finger; and (d) means for moving said stretching fingers outwardly relative to said cavity thereby initially to stretch the associated lid and thereafter effecting further movement of said stretching fingers to cause the inner ends of said stripper blades to move upwardly to push the sidewall of the associated lid off the lips on said stretching fingers, whereby the sidewall of the lid will contract against the sidewall of the associated container and effect sealing of the upper end thereof.

2. The container sealing machine in accordance with claim 1 further comprising a housing about said frame wherein said frame includes a base plate extending transversely of said housing and having an aperture therein to partially define said cavity, said stretching fingers being slidably mounted on the upper surface of said base plate.

3. The container sealing machine in accordance with claim 2 wherein there is included on said base plate a cam ring rotatable about a vertical axis, said cam ring and stretching fingers having coacting means thereon to produce said outward movement of said stretching fingers upon said rotation of said cam ring.

4. The container sealing machine in accordance with claim 3 wherein said coacting means comprises an angularly oriented cam track on one of said cam ring and stretching fingers and a cam follower on the other of said cam ring and stretching fingers seated in said cam track.

5. The container sealing machine in accordance with claim 4, wherein said cam track is a channel formed in said cam ring.

6. The container sealing machine in accordance with claim 5 wherein said base plate has an upwardly sloping cam surface coacting with a second cam follower seated thereon and acting on the inner end portions of said stripper blades to cam them upwardly.

7. The container sealing machine in accordance with claim 1 wherein there is included a housing about said frame which provides a cavity into which an associated container may be placed and wherein said frame has a base plate extending transversely of said housing and having an aperture therein to receive the upper end portion of the associated container, said stretching fingers being slidably mounted on the upper surface of said base plate.

8. The container sealing machine in accordance with claim 7 wherein there is included lifting means for moving an associated container upwardly in said cavity in said housing into said aperture in said base plate.

9. The container sealing machine in accordance with claim 8, wherein said machine includes a cup holder providing a recess in its upper surface to seat the base of an associated container and reciprocatable vertically by said lifting means.

10. The container sealing machine in accordance with claim 8 wherein there is included switch means to effect operation of said moving means and said lifting means.

11. In a container sealing machine for placing an elastomeric lid having a transverse wall and a depending sidewall extending thereabout upon the open upper end of a container, the combination comprising:

(a) a housing having a cavity therewithin adapted to seat a container to be capped and an aperture for placing a container in said cavity;

(b) a frame providing a cavity adapted to receive therein the upper portion of a container to be capped;

(c) a multiplicity of stretching fingers movably mounted on said frame and extending inwardly of said cavity, said stretching fingers having upstanding lips at their inner ends adapted to engage the inside surface of the sidewall of an associated lid;

(d) a stripper blade on each of said stretching fingers, said stripper blades having their inner ends movably supported thereon for vertical movement relative to its associated stretching finger;

(e) means for moving said stretching fingers outwardly relative to said cavity in said frame thereby initially to stretch the associated lid and thereafter effecting further movement of said stretching fingers to cause the inner ends of said stripper blades to move upwardly to push the sidewall of the associated lid off the lips on said stretching fingers, whereby the sidewall of the lid will contract against the sidewall of the associated container placed therebetween and effect sealing of the upper end thereof; and (f) means for lifting a container upwardly in said cavity and into the stretched lid.

12. The container sealing machine in accordance with claim 11 wherein said frame includes a base plate extending transversely of said housing and having an aperture therein to partially define said cavity in said frame, said stretching fingers being slidably mounted on the upper surface of said base plate.

13. The container sealing machine in accordance with claim 12 wherein there is included on said base plate a cam ring rotatable about a vertical axis, said cam ring and stretching fingers having coacting means thereon to produce said outward movement of said stretching fingers upon said rotation of said cam ring.

14. The container sealing machine in accordance with claim 11 wherein said machine includes a cup holder providing a recess in its upper surface to seat the base of an associated container and reciprocatable vertically by said lifting means.

15. In a method for sealing a container with an elastomeric lid having a transverse wall and a depending sidewall, the steps comprising:

(a) placing a lid on a multiplicity of stretching fingers extending inwardly of a cavity, said stretching fingers having upstanding lips at their inner ends engaging the inside surface of said lid and stripper blades thereon with their inner ends movably supported thereon for vertical movement relative to said stretching fingers;

(b) moving said stretching fingers outwardly relative to said cavity initially to stretch said lid;

(c) moving a container upwardly against the transverse wall of the stretched lid; and (d) effecting further movement of said stretching fingers to cause the inner ends of said stripper blades to move upwardly relative to said stretching fingers and move the sidewall of said lid off the lips on said stretching fingers, whereby the sidewall of said lid contracts against the sidewall of said associated container and effects sealing of the upper end thereof.

16. The sealing method in accordance with claim 15 wherein said lid is formed from a biodegradable latex.

17. The sealing method in accordance with claim 15 wherein, after said stretching fingers are moved outwardly to stretch said lid, the container is moved upwardly sufficiently to distend said transverse wall of said lid upwardly and said stretching fingers are then moved inwardly, whereby said sidewall of said lid is caused to lift off said lips.

* * * * *